US006466761B1

(12) United States Patent
Rene et al.

(10) Patent No.: US 6,466,761 B1
(45) Date of Patent: Oct. 15, 2002

(54) DUPLEX TRANSFER APPARATUS AND PROCESSES

(75) Inventors: Marc B. Rene, Rochester, NY (US); David C. Robinson, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/711,375

(22) Filed: Nov. 14, 2000

(51) Int. Cl.[7] ..... G03G 15/16; G03G 15/20
(52) U.S. Cl. ..... 399/308; 399/307; 399/384
(58) Field of Search ..... 399/307, 308, 399/309, 313, 297, 384

(56) References Cited

U.S. PATENT DOCUMENTS 4,287,017 A * 9/1981 Lopata et al.
5,070,369 A * 12/1991 Mahoney et al. ..... 399/309 X
5,132,721 A * 7/1992 Randall
5,408,302 A 4/1995 Manzer et al.
5,410,384 A 4/1995 Wachtler
5,428,430 A * 6/1995 Aslam et al. ..... 399/307
5,455,668 A 10/1995 De Bock et al.
5,461,470 A 10/1995 De Cock et al.
5,526,107 A * 6/1996 Bronstein
5,848,323 A * 12/1998 Umeda et al.
5,893,018 A * 4/1999 De Bock et al. ..... 399/307 X
5,893,020 A * 4/1999 Atsumi
5,970,295 A * 10/1999 Samizo ..... 399/309
6,032,015 A * 2/2000 Umeda et al.
6,097,921 A * 8/2000 Kageyama ..... 399/309 X

FOREIGN PATENT DOCUMENTS

GB 2078173 A * 1/1982

* cited by examiner

*Primary Examiner*—Susan S. Y. Lee
(74) *Attorney, Agent, or Firm*—Robert Thompson

(57) ABSTRACT

An apparatus including: a transfer station adapted to receive a continuous web feed, wherein situated on both sides of the continuous web are transferable paired printed images, and the station is further adapted to thereafter simultaneously transfer the paired printed images from the continuous web to respective substrates.

24 Claims, 4 Drawing Sheets

DUPLEX TRANSFER APPARATUS AND PROCESSES

REFERENCE TO COPENDING AND ISSUED PATENTS

Attention is directed to commonly owned and assigned U.S. Pat. Nos. 5,878,320, issued Mar. 2, 1999, and 5,875,383, issued Feb. 23, 1999, to Stemmle et al., respectively entitled "CONTINUOUS IMAGING OF A CONTINUOUS WEB SUBSTRATE WITH A SINGLE PRINT ENGINE WITH A PHOTORECEPTOR BELT SEAM" and "DUAL MODE INTERCHANGEABLE MODULES CUT SHEET OR WEB PRINTING SYSTEM WITH A SINGLE XEROGRAPHIC CUT SHEET PRINT ENGINE." The U.S. Pat. No. 5,878,320 patent discloses a continuous web substrate printing system which can utilize a single otherwise conventional or existing xerographic print engine (normally printing conventional cut sheet print substrates) having an endless photoreceptor belt with a belt seam requiring a section of that belt to be un-imaged in each belt rotation, yet provide continuous directly abutting images on the printed web, to avoid paper scrap. A special simplex or duplex continuous web printing substrate supply module may be docked with the cut sheet print engine to form an integral web printing system. It has a web feeding and image transfer system for appropriately feeding the continuous web printing substrate uncut into the print engine for image transfers to one or both sides of the web from the imaging surface of the print engine. For duplex printing a controlled expandable/contractible web loop may be provided in between two alternately engaged transfer stations, for alternately transferring batches of page print images onto opposite sides of the web in the proper sequence and positions, with interruption of the web feeding in the web segments in those areas. This is desirably coordinated with skipping and compensating for the un-imaged belt seam areas to avoid creating blank paper areas between any images on the web which would otherwise have to be cut off and wasted. The U.S. Pat. No. 5,878,320 patent discloses a plural mode printing system utilizing a cut sheet print engine for printing conventional cut sheet print substrates, in which page print images are generated and transferred to the cut sheets at an image transfer station. This plural mode printing system selectively provides printing onto either the cut sheets or onto an uncut continuous web printing substrate, in the same cut sheet print engine. An independently moveable continuous web printing substrate supply module is selectively operatively docked with the cut sheet print engine. That web printing module has a web feeding and image transfer assistance system for feeding the continuous web uncut into the cut sheet printing engine for transferring the page print images onto the web instead of onto cut sheets when the print engine is operatively docked with the web printing substrate module. The web printing module does not itself need to print. Rather, it can feed an extended loop of the continuous web into the cut sheet print engine image transfer station. The web module may provide either simplex printing or duplex printing onto both sides of the web with a duplexing system for feeding the web into the print engine for image transfer twice, with web inversion in between. The web modules are also preferably interchangeable with an optional cut sheet supply module.

The disclosure of the above mentioned patents are incorporated herein by reference in their entirety. The appropriate components and processes of those patent applications may be selected for the products and processes of the present invention in embodiments thereof.

BACKGROUND OF THE INVENTION

The present invention is directed to a duplex printing apparatus and printing method thereof. More specifically the present invention is directed to a printing apparatus and to a duplex image simultaneous-transfer station subsystem used therein or a duplex image simultaneous-transfer station which can be attached thereto. Even more specifically the present invention is directed to an duplex image transfer station subsystem or accessory which is adapted to receive a continuous duplex web feed, that is a donor web feed where both sides of the continuous web bear transferable paired printed images, and the transfer station is further adapted to thereafter simultaneously transfer the paired printed images from the continuous donor web to respective receivers, for example, receiver webs or suitable printed image substrates.

Duplex printing systems generally are well known in the art, reference for example, the aforementioned commonly owned U.S. Patent Nos. and those U.S. Patent Nos. that follow, the disclosures of which are incorporated herein by reference in there entirety.

PRIOR ART

In U.S. Pat. No. 5,408,302, issued Apr. 18, 1995, to Manzer et al., there is disclosed a printing or copying machine has a photoconductor (10) with associated recording and developing station (EY, EM, EC, EB) for producing single-color or multi-color toner images on the intermediate image-carrier (10). The toner images are transferred electrostatically, in a transfer zone (T) onto a belt-type transfer element (16) and then, in transfer and fusing zones (U1, U2), printed from the underneath from the transfer element onto the recording carriers (24). In order to facilitate the fusing of the transfer image in the transfer and fusing stations (U1, U2), heating units (23, 31) for heating the toner images on the transfer element (16) and/or for heating the recording carrier (24) are provided. Between the first and the second transfer and fusing station (U1, U2), a turning station (W) is arranged. The printing or copying machine can be operated in the simplex and duplex printing mode of operation to produce single-color or multi-color copies.

In U.S. Pat. No. 5,461,470, issued Oct. 24, 1995, to De Cock et al., there is disclosed an electrostatographic single-pass multiple station (e.g. multi-color) duplex printer is described for forming an image onto a web. The printer has at least three toner image-producing electrostatographic stations. Each station has a rotatable endless surface in the form of a photoconductive drum onto which a toner image can be formed. The printer also includes drive rollers for conveying the web in succession past the stations. Corona discharge devices transfer the toner image on each rotatable surface onto the web. The image-producing stations are arranged in two sub-groups, the drum of one sub-group forming a backing roller for the other sub-group, and viceversa, thereby to enable simultaneous duplex printing.

In U.S. Pat. No. 5,893,018, issued Apr. 6, 1999, to De Bock et al., there is disclosed a single pass, multi-color electrostatographic printer which includes a transfer member which is driven along a continuous path. Several toner images of different colors are electrostatically deposited in powder form in registration with each other on the transfer member to form a multiple toner image thereon. A substrate is fed into contact with the transfer member. The multiple toner image is thereby transferred to at least one face of the substrate. The printer includes heaters for heating the multiple toner image on the transfer member in advance of the transfer of the image to the substrate and cooling devices for cooling the transfer member following the transfer of the multiple toner image therefrom to the substrate to a temperature below the glass transition temperature Tg of the toner, prior to the deposition of further toner images on the transfer member.

In U.S. Pat. No. 5,455,668, issued Oct. 3, 1995, to De Bock et al., there is disclosed an electrostatographic single-pass multiple station multi-color printer for forming an image onto a web, for example of paper. A plurality of toner image-producing electrostatographic printing stations each have a rotatable endless surface such as the photoconductive surface of a cylindrical drum onto which a toner image can be formed. The paper web is conveyed in succession past the printing stations. The speed and tension of the web is controlled while it is running past the printing stations. Guiding rollers which determine for the web wrapping angles of about 15° about the drum surface. A corona device transfers the toner image on each drum onto the web. The corona device, the wrapping angles omega. and the web tension are such that adherent contact of the web with the drum surface is such that the moving paper web controls the peripheral speed of the drum in synchronism with the movement of the web. Slippage between the drum surface and the paper web is thereby eliminated, enabling accurate registration of superimposed images on the paper web.

In U.S. Pat. No. 5,410,384, issued Apr. 25, 1995, to Wachtler, there is disclosed a printing or copying device having a photoconductor drum (10) for receiving two adjacently arranged toner images for a recto and a verso of a recording medium (15). Provided for the simultaneous transfer of the toner images onto the recording medium (15) are two separate transfer ribbons for the recto toner image and the verso toner image. In this case, one transfer ribbon is deflected over a deflection device in such a way that the transfer ribbons (T1 and T2) are positioned one above the other in a fuser station (19) designed as a thermal printing fuser station. The recording medium (15) is passed between the transfer ribbons (T1 and T2) and is thus printed verso/recto simultaneously. The aforementioned references are incorporated by reference herein in their entirety.

In duplex printing apparatuses and duplex printing processes of the prior art, various significant problems exist and include, for example, a substantial limitation in the types and kinds of imageable substrates available for use in current xerographic and the like printing devices, such as the size and width of substrates.

These and other problems and disadvantages are avoided, or minimized with the apparatus and processes of the present invention. There remains a need for simple, and economical apparatus and processes thereof for duplex imaging and printed image transfers. The apparatus and method of the present invention are useful in many applications, for example, in a variety of specialty printing applications including cut-sheet and continuous-sheet image receiver materials, fabric and specialty image receiver materials, for use in for example, electrophotographic, ink jet, or the like imaging processes.

SUMMARY OF THE INVENTION

Embodiments of the present invention, include:

An apparatus comprising:

a transfer station adapted to receive a continuous donor web feed, wherein situated on both sides of the continuous donor web are transferable paired printed images, and the station is further adapted to thereafter simultaneously transfer the paired printed images from the continuous donor web to respective receiver substrates;

A process comprising: simultaneously transferring paired printed images from opposites sides of a continuous donor web feed to respective receiver substrates; and A print-transfer process comprising:

forming paired printed images on opposite sides of a continuous donor web;

feeding the continuous donor web with the resulting paired printed images on opposite sides of the donor web to a transfer station; and simultaneously transferring the paired printed images from the continuous donor web feed to respective receiver substrates.

These and other embodiments of the present invention are illustrated herein.

DETAILED DESCRIPTION OF THE INVENTION

Figure 1:
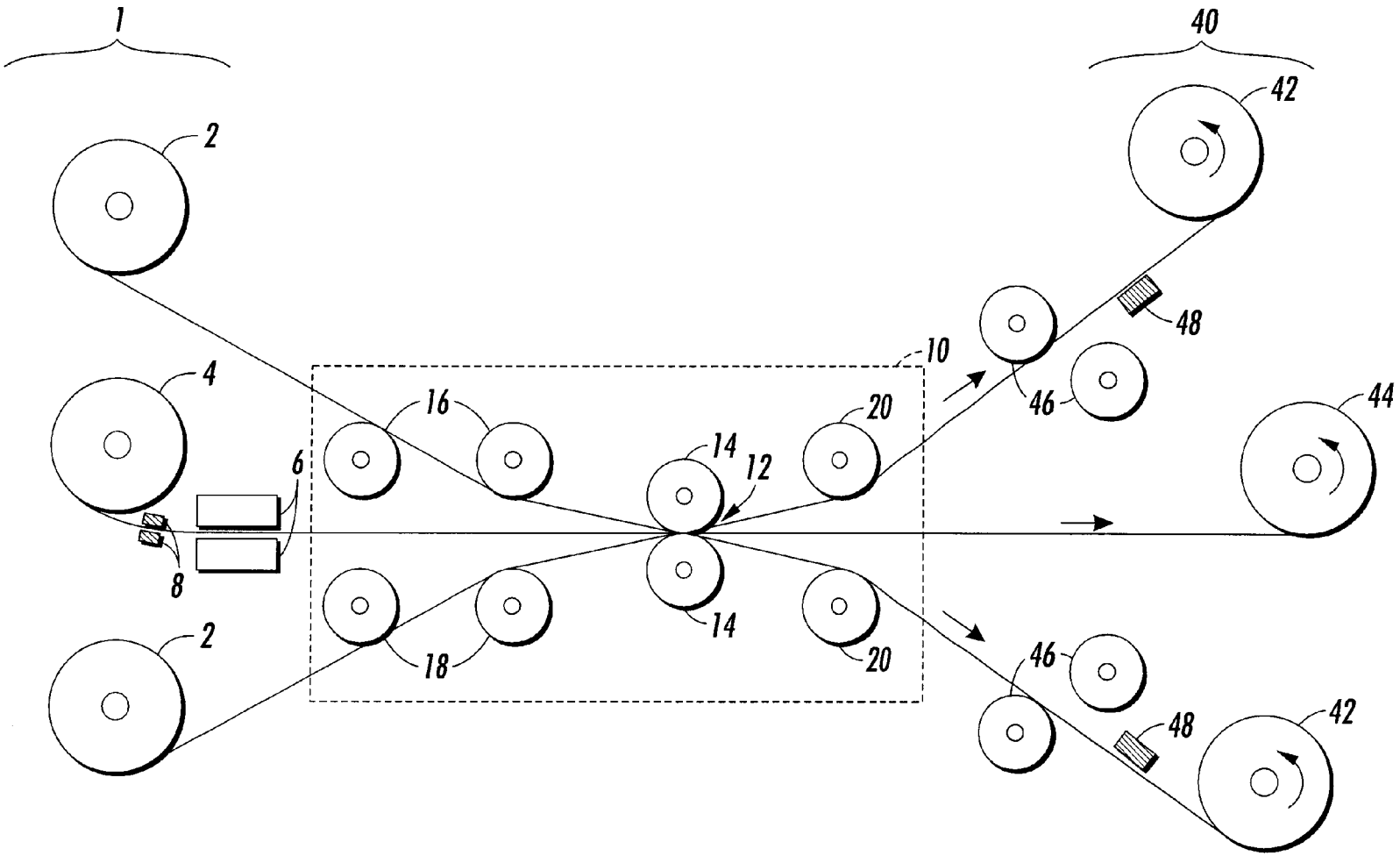
FIG. 1 illustrates a portion of an exemplary duplex transfer or simultaneous-transfer apparatus and method thereof in embodiments of the present invention which apparatus employs a duplex roller nip.

The apparatus and marking processes thereof of the present invention may be used in a variety of applications to produce printed materials with either or both image and text bearing objects, for example, printed apparel, such as T-shirts, clothing accessories, and other utilitarian objects, such as, mouse pads, bicycle seat covers, posters, kites, and the like materials and objects.

An advantage of the present invention is that the marking apparatus in conjunction with the duplex transfer apparatus and processes can afford high levels of print productivity by way of moderate to high speed duplex operation at a relatively or comparatively low cost by virtue of a simultaneous-transfer duplex subsystem or simultaneous-transfer duplex module being separable from a simplex or duplex print engine. Thus in embodiments the simultaneous-transfer duplex module can be conveniently disconnected from a duplex printer or print module and reconnected to the same or another suitably adapted duplex printer or print module as needed and on-demand.

In embodiments, the present invention provides an apparatus comprising:

a transfer station adapted to receive a continuous web feed, which is also known as or referred to as a donor web member, wherein situated on both sides of the continuous donor web feed are transferable paired printed images, and the station is further adapted to thereafter simultaneously transfer the paired printed images from the continuous donor web to respective receivers or suitable substrates.

An "image" or "images" in the context of the present invention can refer to any known image component or image element including but not limited to, for example, one or more picture elements or pixels including text and text elements, and which image or images are capable of being substantially transferred from the donor web to at least one of the receiver webs. An image can be generated from any known image material, such as a dry toner, a liquid ink, a solid meltable ink, and the like materials, and combinations thereof, and which image can be placed on the donor web and can be transferred to one or both of the receiver webs and where the transferred image can optionally be subsequently transferred to another receiver member or material, such as copy sheet, transparency stock, fabric, cardboard stock, and the like known receiver members.

"Duplex transfer" in the context of the present invention refers to the ability to simultaneously or sequentially transfer images from opposite sides of the same donor member, that is a common or singular donor web member, to respective receiver members, such as separate receiver sheets or separate receiver web members.

In embodiments, the transfer station can comprise a nip with a first transfer roll adapted to contact one side of the continuous web feed, and a second transfer roll adapted to contact the other side of the continuous web feed and directly opposite the first transfer roll. The paired printed images on the web can be, for example, the same or identical images, or alternatively different images. The contact of the transfer rolls with the web can be, for example, continuous or intermittent, that is, optionally reversibly engaged and disengaged, and optionally registered with the presence or absence of an image on the web surface. The engagement and disengagement of the rolls is, in embodiments, preferably simultaneous. The respective receivers or suitable substrates can be, for example, the same or similar material. Alternatively, the respective receivers or suitable substrates can be compositionally different materials. The transferable paired printed images on the web can be generated from any suitable or conventional printing media and process, for example, toner, ink, paint, plastic, and mixtures or combinations thereof, and the like imaging or marking materials and media. The transferable paired printed images on the web can, in embodiments, include a peel layer or release layer situated between the printed image or the web and the receiver substrate, which layer facilitates transfer and ensures high fidelity images. grams per square meter.

The web can be any suitable or conventional flexible web media including materials such as, metal, composites, plastics, rubbers, such as EPDM rubber, TYVEK®, synthetic papers such as TESLIN® available from P.P.G., films, foils, magnetic sheets, heavyweight paper stocks, for example, of from about 15 to about 30 points, and greater than, for example, about 300 grams per square meter (gsm), for example, as found in heavy printable paperboards, and combinations or mixtures thereof. The web can be continuous and endless, for example, a belt, a drum, and the like web members. Alternatively, the web can be continuous but instead can have ends, such as a beginning or lead first end and tail or trailing second end, and which continuous ended web can be delivered to and retrieved from the print module and the transfer station by, for example, a dispense reel and a take-up reel.

In embodiments of the present invention there is provided a process comprising: simultaneously transferring paired printed images from a continuous donor web or feed web to respective receiver webs or substrates. The simultaneous transfer can be accomplished efficiently and inexpensively with the duplex transfer station of the present invention, for example, at about from 2 to about 2,000 image transfers per minute, preferably from about 2 to about 1,000 images transfers per minute, more preferably from about 2 to about 400 images transfers per minute, and most preferably 50 to about 400 images transfers per minute. It is readily understood that the efficiency of the duplex transfer station of the present invention can be further enhanced or controlled by, for example, varying the parameters of the donor web and the receiver webs accordingly, such as the release efficiency of the webs and the width of the webs. The release efficiency of the webs can be enhanced by for example, coating the webs with a high release or non-stick coating, such as poly(tetrafluoroethylene), poly(silicones), poly(fluorinated acrylates), and the like based coatings. Other high performance coatings suitable for coating the webs are available from Transprint Co., Webster, N.Y., and which coatings can provide durability, such as scratch resistance, ultraviolet and the like light resistances, and high image fidelity, such as high gloss arising from highly smooth surface finishes provided by the web coating materials.

In embodiments of the present invention there is provided a printing-transfer process comprising:

- forming paired printed images on opposite sides of a continuous web;
- feeding the continuous web with the resulting paired printed images on opposite sides of the web to a transfer station; and
- simultaneously transferring the paired printed images from the continuous web feed to respective substrates.
- The transfer station can preferably include two or more nip rolls or equivalent structures that provide, for example, heat, pressure, and combinations thereof, simultaneously to the donor member web, the paired printed images on the web, and the respective receiver substrates. The heat provided by the heated nip roll can be from about 50 to about 250° C. Pressures can be, for example, from about 0.2 to about 150 p.s.i.

Formation of the paired images can be accomplished, for example, by any known and suitable image forming technology which is capable of generating black and white, and preferably, full color images, such as dry or liquid xerography, ink or ink jet printing, ionography, magnetography, silver halide photography, and combinations thereof, reference the aforementioned U.S. Pat. Nos. 5,878,320, and 5,875,383. Forming paired images on the web can be accomplished with a single or a dual, that is duplex, image marking device. Thus in embodiments, a single or simplex marking engine can be configured with another single or simplex marking engine in combination with a pair of single or simplex continuous intermediate web feed members to generate images on an intermediate transfer web which are in effect duplexed or paired, that is, opposite sides of the continuous donor web member each carry an image wherein the image can be the same or different.

In embodiments of the present invention there is provided an apparatus comprising:

- a donor web member with images residing on both sides of the web;
- two receiver web members adapted to contact the donor web member at a common point and to receive the transferable images from the donor web member;
- a transfer station adapted to facilitate the transfer of the images from the donor web member to the receiver web members.

The transfer station, in embodiments, can include, for example, two transfer members with each transfer member being situated on opposite sides of a confluence region of the donor web member and two receiver web members. In embodiments the transfer members, for example, heated rollers, heated belts, hybrids thereof, or combinations thereof, and the like transfer members, can be reversibly retractable from the confluence region. The retractability can provide additional process advantages and flexibility, for example, in regulating and moderating the heating of the web members, and in conditioning or facilitating the web members and in conditioning and facilitating the transfer of transferable images. In embodiments, each of the transfer members can be at least one heated roller and the above mentioned confluence region can be an area between the heated roller or rollers and the web members. Similarly, in embodiments, each transfer member can be at least one heated belt and the confluence region can be the area between the heated belts and the web members. It is readily evident that the transfer members can be combinations of the above mentioned heated rollers and heated belts, and as illustrated herein. The transfer station can in embodiments further comprise conditioning members, such as nip rollers or nip-belts, that are capable of being adapted for pre-transfer treatment or post-transfer treatment of either or both the donor web member and two receiver web members. Alternatively, the conditioning members can be adapted for pre-transfer treatment or post-transfer treatment of the images residing on the respective donor and receiver web members. The pre-transfer treatment or post-transfer treatment of the donor and receiver web members can be used to facilitate, for example: transfer of the images; removal of residual or non-transferred image materials; pre-conditioning, that is prior to transfer, of the images; post-conditioning, that is after transfer of the images; and the like manipulations. In embodiments, the pre-transfer treatment or post-transfer treatment of the web members can include, for example: heating, such as by known methods of convection, irradiation, conduction, and the like methods; cooling, such as by known methods of convection, conduction, and the like methods; evacuation, such as by application of a vacuum to remove particles, liquids, solvents, vapors, and the like materials; applying pressure by known methods, such as mechanically, pneumatically, and the like methods; vibrating such as mechanically or ultrasonically; cleaning, by known methods, such as sweeping, scraping, abrading, smoothing, and the like known methods; or depositing, such as a material or substance which can facilitate image transfer, or imaging integrity, such as an anti-caking agent or a release agent, and which materials can be applied by known deposition methods such as dusting, spraying, electrostatic deposition, and the like methods.

Referring to the Figure, FIG. 1 illustrates a portion of an exemplary duplex or simultaneous-transfer apparatus and method thereof in embodiments of the present invention which apparatus employs a roller duplex nip. A source module (1) provides dual substrate or receiver web feed rolls (2) which can be the receiver substrate, or alternatively, they can support and transport a receiver substrate on a side of the feed roll (2) which comes into direct contact with the feed roll (4). Feed roll (4) provides a duplex image donor web or duplex image bearing web which can carry paired or duplex images (8) and which images can be generated by any known conventional and transferable image process and material lmages(8) residing on the surface of duplex image donor web feed member or roll (4) can be preconditioned with an image preconditioning apparatus (6) on one or both sides of the duplex image donor web feed member or roll (4) and in the presence of the images or alternatively in the absence of the images, for example, in-between, before-and-after, or during, the passage of images through the donor web-image preconditioning station. Preconditioning, as discussed further below can include, for example, irradiating a radiation-curable liquid ink image. It is readily evident that the donor web member preconditioning station (6) can optionally be situated either or both within and without(as shown) the transfer station (10). Feed roll (4) can be, for example, an imaging member, an intermediate transfer member, and the like image bearing or image web transport structures. Transfer of images(8) from the surface of duplex image donor web feed roll (4) to the surface of image receiver substrate web (2) is accomplished within the confines of transfer module (10) which includes a transfer nip (12) formed by confluence of at least a pair of nip rollers (14), both image receiver substrate webs from feed rolls (2), and image donor web from feed roll (4). The image transfer can be accomplished, for example, by application of heat, by pressure, or both heat and pressure, and can be facilitated, for example, by a radiant heat or equivalent heating and preconditioning station (6) which, for example, softens the duplex images (8) on the image donor substrate or feed roll web (4). The nip rollers (14) can be heated to any suitable temperature to effect satisfactory transfer of the paired images (8), for example, from about 300 to about 500° F., preferably from about 325 to about 475° F., and more preferably from about 350 to about 440° F. It is readily understood that the temperature regime selected can be highly dependent upon, for example, the materials selected for web members and heating rollers or equivalents and their respective heat transfer characteristics, the relative speed of the web members and heating rollers or equivalents, the image materials selected and there layer thickness and there heat transfer characteristics, the ambient operating temperature, and like consideration. It is readily apparent that the aforementioned factors can be considered and balanced and can influence the success and efficiency of the operating process. Similarly, the receiver substrates (2) can be preconditioned to facilitate the receipt of images, for example, by application of heat, pressure, or both, with a heater roll or heater member, such as the preheating conditioning rolls (16 and 18). Conditioning rolls (16 and 18) can be preheated, for example, from about 400 to about 450° F., to facilitate image transfer and to minimize thermal stress or thermal deterioration of the receiver substrate web. Transfer of paired images (8) from image donor web (4) to image receiver substrates (2) results in transferred and separated images (48) residing on respective receiver substrates (2). The resulting transferred images residing on respective receiver webs (2) can be managed in receiver module (40). The transferred images(48) residing on the respective receiver substrate webs can be managed by, for example, take-up on respective take-up drive rolls (42). The resulting transferred images (48) can optionally be conditioned, for example, to improve image quality, fix properties, and the like desirable properties by, for example, post transfer and fuse conditioning, such as with cooling rollers (20) and cooling rollers (46). In alternative embodiments, the cooling rollers (20) can be adapted for post transfer heating rather than cooling, for example, to provide a heating gradient profile to the receiver substrate web members. The donor web (4) freed of images can be managed, for example, by take-up on drive roll (44) and can be preferably reused in other subsequent batch or semi-continuous duplex imaging processes.

Figure 2:
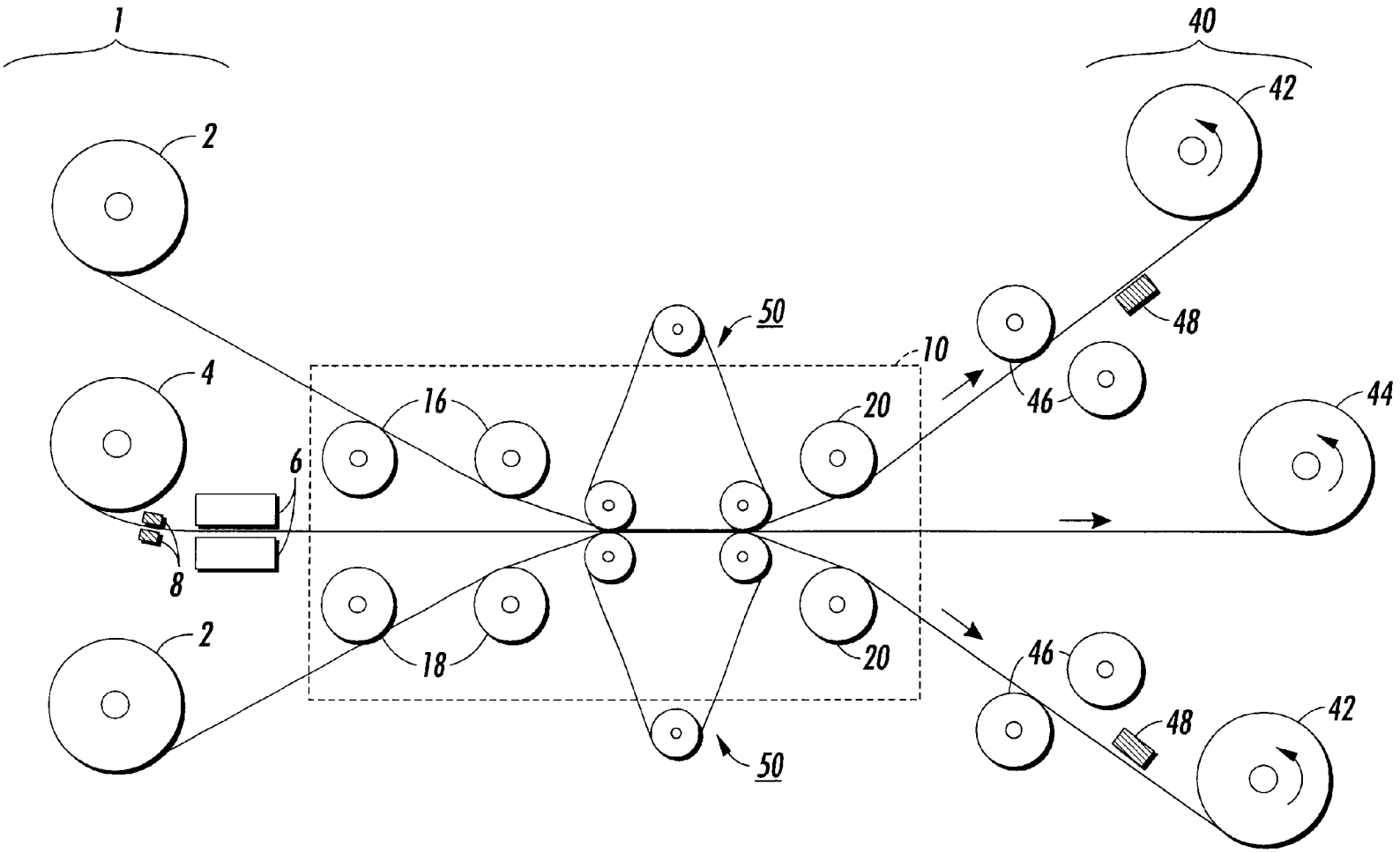
FIG. 2 illustrates a portion of an alternative exemplary duplex transfer or simultaneous-transfer apparatus and method thereof in embodiments of the present invention which apparatus employs a duplex belted nip.

FIG. 2 similarly illustrates a portion of an alternative exemplary duplex or simultaneous-transfer apparatus and method thereof in embodiments of the present invention. The illustrated duplex transfer apparatus employs a belted duplex nip member (50). The belted duplex nip (50) is preferably heated by one or more of the supporting rollers (three shown) although it is readily understood that the belted duplex nip can employ a plurality of heated rollers, for example from two to about 10 rollers, or equivalents, which can either or both support and heat the flexible belt member. It is also readily understood that one or more of the rollers can be adapted to drive the belt member or members in either concurrent or contrary rotational directions relative to the interposed donor belt or web (4) and the receiver belt or web members (2). It is also readily understood that a main purpose of the belted duplex nip members (50) is to controllably maximize the dwell time of either or both pressurized and heated surfaces opposing the non-image bearing surface of the receiver substrate or web members (4) so as to promote and achieve optimal image transfer while minimizing the possibility of thermal damage to the web members (2 and 4) and the nip members (50) from, for example overheating, by providing a mechanism for managing rapid heating, rapid heat dissipation, or alternative heat transfer avenues. It is readily evident that the nip members (50) can optionally be situated either or both(as shown) within and without the transfer station (10).

Figure 3:
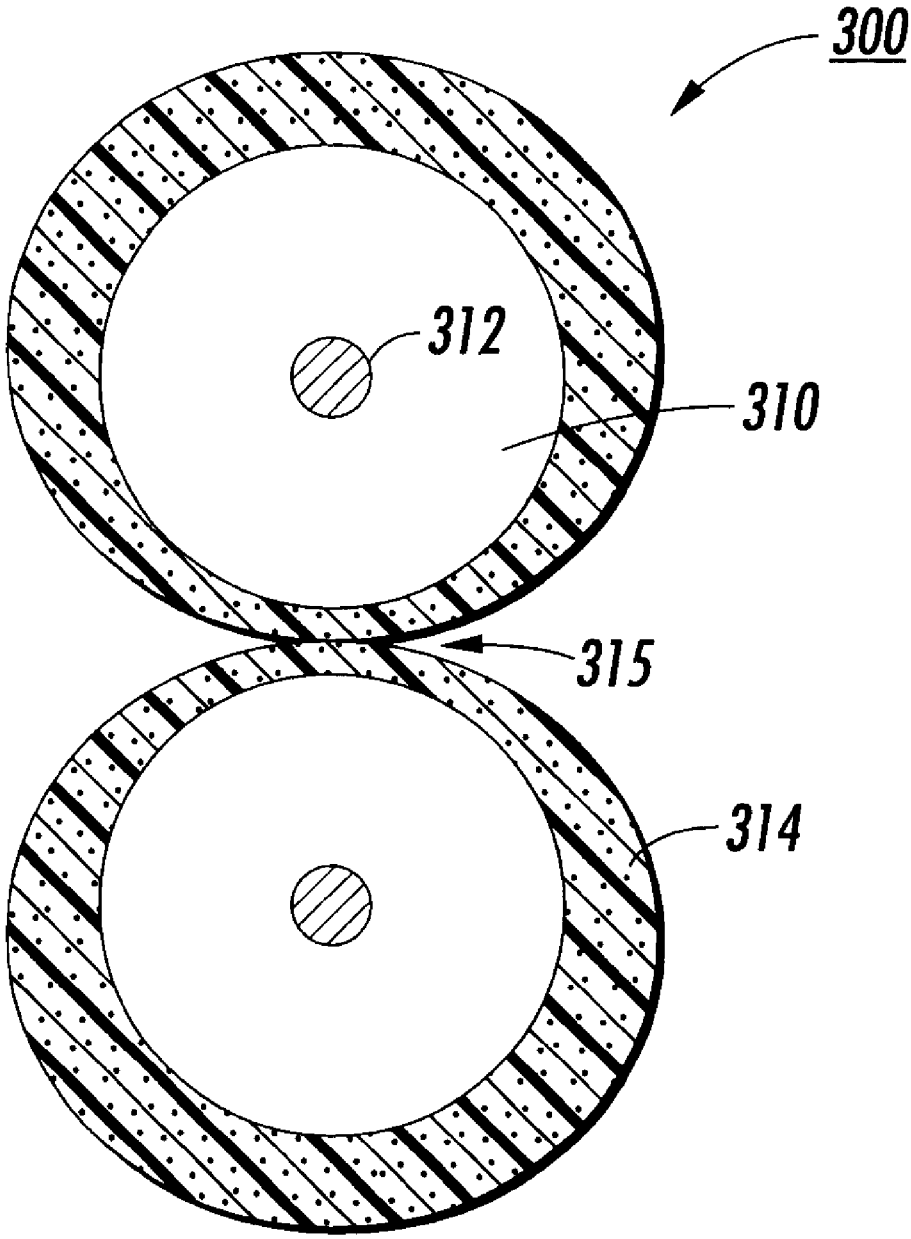
FIG. 3 illustrates a modified duplex roller nip as an alternative to the nips of FIG. 1 or 2 in embodiments of the present invention.

FIG. 3 illustrates in embodiments of the present invention a modified roller duplex nip (300) as an alternative to the nip configurations shown in FIG. 1 or 2. The modified roller duplex nip (300) consists of a pair of opposing compressible rollers where their loci of confluence, along with the donor web(not shown) and the receiver webs (not shown), creates a transfer nip region (315). Each roll consists of a hard inner core (312) which core contains a heater element (310), and the core (312) is surrounded by a malleable or compressible outer core (314) or outer surface coating, and which outer core or outer surface coating material provides for efficient heat transfer, provides a convenient method of adjusting the nip dimension or length and the corresponding dwell time properties of the operating nip region (315). In embodiments, a maximum compression can provide, for example, a nip region (315) length of about 1 to about 5 inches, and can depend upon other aspects, such as materials of construction, compressibility of the outer core coating (314) material, compressibility of the web materials, speed of operation such as inches per second of web speed, thicknesses of the image materials residing on and between the webs, and the like considerations. By adjusting the above variables and parameters the dwell time can be controlled to a high degree and provide optimal transfer rates and economic process speeds. The dwell time in embodiments can be, for example, from 0.1. to about 10 seconds, and preferably from about 0.1 to about 5 seconds, and more preferably from about 1 to about 5 seconds. Shorter dwell times may lead to incomplete transfers whereas longer dwell times may lead to thermal damage to the images and image quality, or to the web members.

Figure 4:
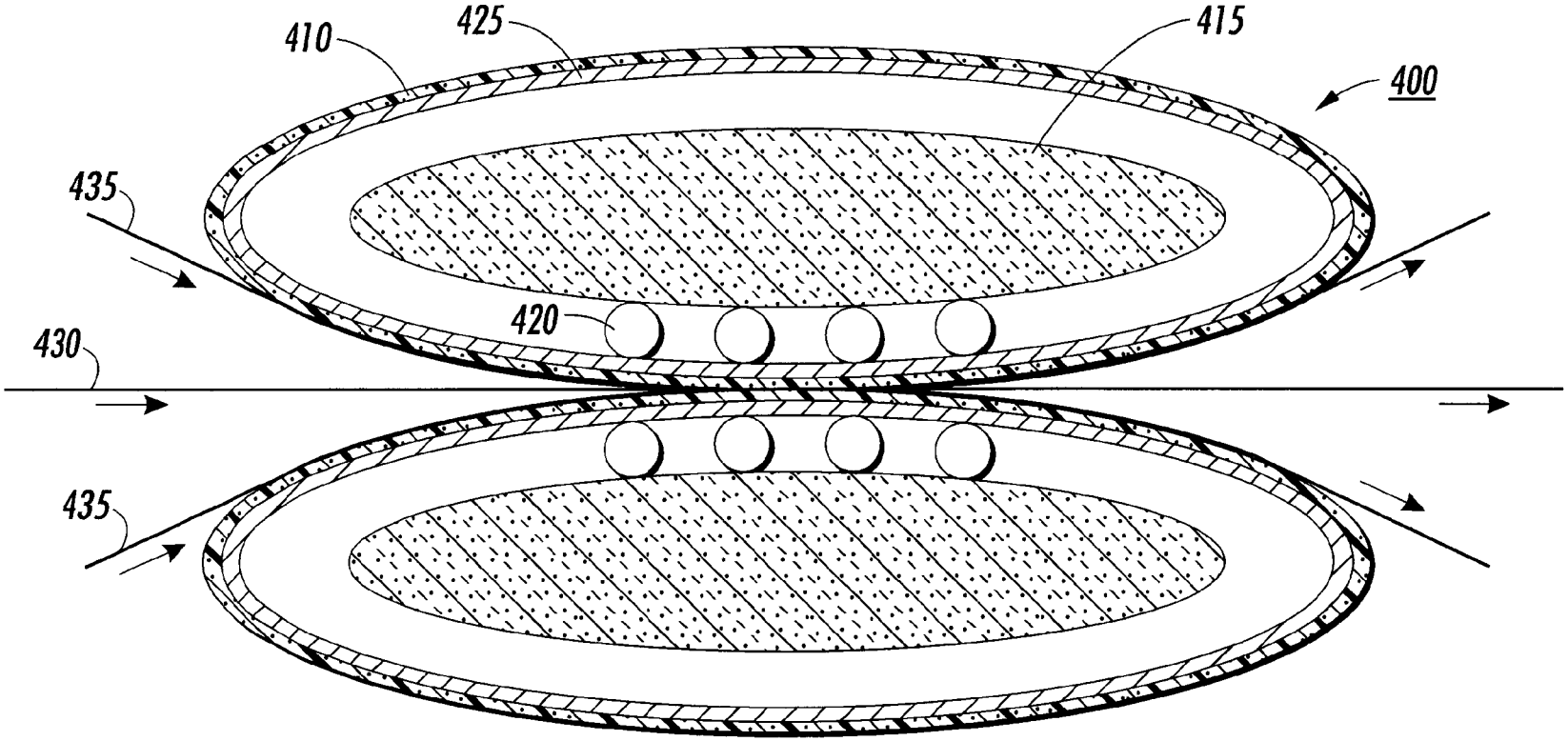
FIG. 4 illustrates another modified or hybrid duplex nip as an alternative to the duplex nips of FIG. 1 or 2 in embodiments of the present invention.

FIG. 4 illustrates in embodiments of the present invention a modified or hybrid duplex nip (400) as an alternative to the duplex nips of FIG. 1, 2, or 3, and which modified duplex nip (400) provides an extension of the dwell time control concept enunciated above. The hybrid duplex nip (400) can be formed by, and is reminiscent of, a pair of track surface opposed "half-track" members, with each track member consisting of a malleable and compressible transfuse outer layer or belt (410), a heating element (415), such as a ceramic or equivalent heater which is capable of uniform heating, including convective heating, conductive heating, and combinations thereof of both an inner layer or belt (425) and the outer contact layer or belt (410). The combined inner and outer belts (425 and 410) can be supported and rotated by of one or more, or a series of rollers (420), such as thermally conductive metal, composite, or ceramic rollers, such as solid or hollow core rollers, to circuitously and continuously advance the surface of the contact belt (410) to and away from the confluence region of the hybrid duplex nip (400) and the combined and interposed donor web (430) and the receiver webs (435). It is readily evident that hybrid duplex nip (400), which can provide uniform and continuous heating of the confluence region, is highly suitable for high speed and high heat continuous operation. However, uniform and continuous heating may require that the outer contact layer or belt (410) and the inner layer or belt (425) be adapted appropriately to withstand the heightened thermal stresses and thermal demands of continuous operation, for example, by selection of materials that are resistant to, or inert to, higher temperature regimes. Exemplary materials include, for example, known ceramic or composite materials, or ceramic or composite filled polymeric materials. It is also readily understood that the donor web can carry either or both fused and unfused images depending, for example, on the imaging application, the image fidelity, and the efficiencies desired.

The present invention provides in embodiments an imaging apparatus comprising:

at least one image former, such as a xerographic, liquid development, thermal ink jet, and the like imaging forming apparatuses, where the image former or formers, for example, from 1 to about 10 image formers, are adapted to generate images, for example, sequentially or simultaneously, for example, deposit images, on at least one side, and preferably both sides of the donor web member of the aforementioned duplex transfer apparatus. It is readily evident that the aforementioned duplex transfer apparatus of the present invention can be within or without the imaging apparatus, that is the duplex apparatus of the present invention can be integrated within a printing machine or system, or alternatively, can be used as a reversibly attachable-detachable accessory or post print "add-on" or finishing feature.

It will be appreciated that the duplex web embodiments can alternatively also perform simplex printing, that is, printing on only one or a single side of the web. This may be done in the duplex embodiments by only engaging and using the transfer station and one fuser on one receiver web, for example, either continuously or intermittently, and optionally disintegrating the other receiver web associated with the other fuser member.

An advantage of the present invention is the ability to accomplish wide format printing and transfers, for example, by merely using concomitantly wider webs. In embodiments, the receiver webs can be, for example, from about 2 to about 4 times the width of the donor web, or for example, from about 7 to about 10 feet wide. Alternatively, the productivity efficiencies of the present invention can be accomplished by, for example, accomplishing "re-runs", that is re-imaging the donor web, alone or in combination with "roll-backs" of the receiver webs with an appropriate offset of the receiver web to accommodate subsequent new or identical image transfers, for example, to prepare imaged wall papers with repeated motifs or patterns, imaged paneling, imaged flooring materials, plywood, and the like imaged building and finishing materials, posters, billboard promotionals, and the like indicia. Another advantage of the present invention includes the ability to transfer images to particularly troublesome or irregular surfaces, such as irregular fabrics, including terrycloth, velour, or velvet, and metallic or metalized surfaces, such as aluminum sheet or aluminized MYLAR®, and the like materials. Still another advantage of the present invention is the ability to accomplish mechanical transfers exclusive of or in addition to well known electrostatic transfers.

It is well known in general that interposers, sheet feeders, finishers, print engines and other components of printing systems can be add-on, interchangeable, or substitutable modules. Such modular sub-systems or components can be self-standing and mobile on wheels or tracks. Some examples of docking systems for print engines operatively connecting with independent sheet handling modules are disclosed in U.S. Pat. Nos. 5,553,843 and 5,326,093. Plural opposing print engines for respectively printing the opposing sides of a continuous web are disclosed in, for example, U.S. Pat. No. 3,940,210, and the aforementioned, U.S. Pat. No. 5,455,668.

Other modifications of the present invention may occur to one of ordinary skill in the art based upon a review of the present application and these modifications, including equivalents thereof, are intended to be included within the scope of the present invention.

What is claimed is:

1. An apparatus comprising:

a transfer station adapted to receive a first continuous donor web feed, wherein situated on both sides of the continuous web are transferable paired printed images, and the station is further adapted to thereafter simultaneously transfer the paired printed images from the continuous web to respective receiver substrates.

2. An apparatus in accordance with claim 1, wherein the transfer station comprises a nip with a first transfer roll adapted to contact one side of the continuous donor web feed, and a second transfer roll adapted to contact the other side of the continuous donor web feed, and where the second transfer roll is situated opposite the first transfer roll.

3. An apparatus in accordance with claim 2, wherein the contact of the transfer rolls with the first web is continuous or intermittent.

4. An apparatus in accordance with claim 1, wherein the paired printed images on the first web feed are identical or different images.

5. An apparatus in accordance with claim 1, wherein the respective receiver substrates are continuous web receiver members constructed of the same or similar material as the first web.

6. An apparatus in accordance with claim 1, wherein the respective receiver substrates are different materials.

7. An apparatus in accordance with claim 1, wherein the transferable paired printed images on the first web comprise toner, ink, plastic, or mixtures thereof.

8. An apparatus in accordance with claim 7, wherein the transferable paired printed images on the first web further comprise a peel layer or release layer situated between the printed image and the first web.

9. An apparatus in accordance with claim 1, wherein the first web is continuous and endless.

10. An apparatus in accordance with claim 1, wherein the web is a continuous and has a first end and second end.

11. A process comprising: simultaneously transferring paired printed images from opposite sides of a continuous web feed to respective receiver substrates and wherein the simultaneous transfer is accomplished at a rate of from about 2 to about 400 image transfers per minute.

12. A process comprising:

forming paired printed images on opposite sides of a continuous web;

feeding the continuous web with the resulting paired printed images on opposite sides of the web to a transfer station; and simultaneously transferring the paired printed images from the continuous web feed to respective receiver substrates.

13. A process in accordance with claim 12, wherein the transfer station includes nip rolls that simultaneously provide heat, pressure, or combinations thereof, to the continuous web, the paired printed images, and the respective receiver substrates.

14. A process in accordance with claim 12, wherein heat is applied in a range of from about 50 to about 250° C. and wherein pressure is applied in a range of from about 0.2 to about 150 p.s.i.

15. A process in accordance with claim 12, wherein forming paired images is accomplished by dry or liquid xerography, ink or ink jet printing, ionography, magnetography, lithography, electro-ink imaging, silver halide photography, or combinations thereof.

16. A process in accordance with claim 12, wherein forming paired images on the continuous web is accomplished with one or more image marking device.

17. An apparatus comprising:

a donor web member with images residing on both sides of the web;

two receiver web members adapted to contact the donor web member at a common point and to receive the images from the donor web member;

a transfer station adapted to facilitate the transfer of the images from the donor web member to the receiver web members.

18. An apparatus in accordance with claim 17, wherein the transfer station includes two transfer members with each transfer member situated on opposite sides of a confluence region of the donor web member and two receiver web members.

19. An apparatus in accordance with claim 18, wherein the transfer members are reversibly retractable from the confluence region.

20. An apparatus in accordance with claim 17, wherein each transfer member is at least one heated roller and a confluence region is defined as the area between the heated roller or rollers and the web members.

21. An apparatus in accordance with claim 17, wherein each transfer member is at least one heated belt and a confluence region is defined as the area between the heated belts and the web members.

22. An apparatus in accordance with claim 17, wherein the transfer station further comprises members adapted for pre-transfer treatment or post-transfer treatment of the donor web member and two receiver web members.

23. An apparatus in accordance with claim 22, wherein the pre-transfer treatment or post-transfer treatment of the web members includes heating, irradiating, cooling, evacuating, pressurizing, vibrating, or cleaning.

24. An imaging apparatus comprising:

at least one image former adapted for generating images on at least one side of the donor member of the apparatus in accordance with claim 17.

* * * * *